US005582034A

United States Patent [19]

Naumovitz

[11] Patent Number: 5,582,034

[45] Date of Patent: Dec. 10, 1996

[54] AIR SEPARATION METHOD AND APPARATUS FOR PRODUCING NITROGEN

[75] Inventor: Joseph P. Naumovitz, Lebanon, N.J.

[73] Assignee: The BOC Group, Inc., New Providence, N.J.

[21] Appl. No.: 553,173

[22] Filed: Nov. 7, 1995

[51] Int. Cl.[6] ..... F25J 3/00

[52] U.S. Cl. ..... 62/652

[58] Field of Search ..... 62/652

[56] References Cited

U.S. PATENT DOCUMENTS 4,617,037 10/1986 Okada et al. ..... 62/652

5,349,822 9/1994 Nagamura et al. ..... 62/652

5,396,772 3/1995 Mokeigue et al. ..... 62/652

*Primary Examiner*—Ronald C. Caposella

*Attorney, Agent, or Firm*—David M. Rosenblum; Larry R. Cassett

[57] ABSTRACT

A method of producing nitrogen is a single column nitrogen generator in which first and second coolant streams are used to condense nitrogen-rich tower overhead to provide reflux for the distillation column. One of the coolant streams is composed of liquid having a higher nitrogen content than oxygen-rich liquid produced in a bottom region of the distillation column. This coolant stream is compressed, cooled and recycled to the bottom of the distillation column in order to increase nitrogen recovery.

8 Claims, 1 Drawing Sheet

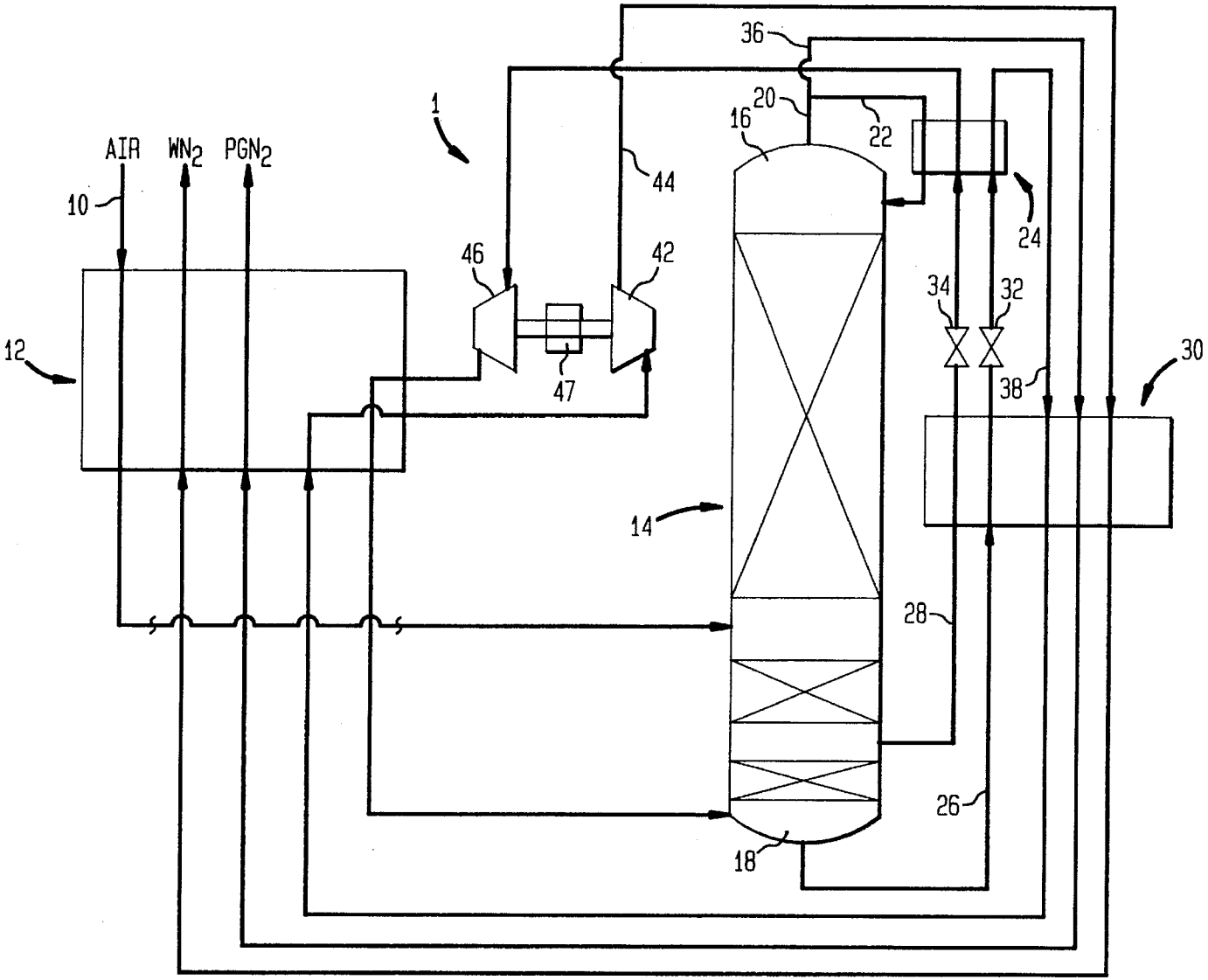
30
24
32
38
34
26
28
22
36
20
16
18
14
44
42
47
46
1
PGN2
WN2
AIR
10
12

AIR SEPARATION METHOD AND APPARATUS FOR PRODUCING NITROGEN

BACKGROUND OF THE INVENTION

The present invention relates to a method and apparatus for producing nitrogen in which air is separated in a distillation column into nitrogen-rich vapor and oxygen-rich liquid. More particularly, the present invention relates to such a method and apparatus in which reflux for the distillation column is produced by condensing a stream of the nitrogen rich vapor through indirect heat exchange with a liquid stream extracted from the distillation column and thereby vaporized. Even more particularly, the present invention relates to such a method and apparatus in which the vaporized liquid stream is compressed, cooled, and introduced back into the distillation column to increase recovery. Even more particularly, the present invention relates to such a method and apparatus in which the liquid stream has a higher nitrogen content than the oxygen-rich liquid.

Nitrogen is produced from single column air separation plants known in the art as nitrogen generators. In one particularly efficient nitrogen generator, filtered, compressed and purified air is separated within a single column to produce a nitrogen-rich vapor as tower overhead and oxygen-rich liquid as column bottoms. A head condenser is provided to condense a stream of the nitrogen-rich vapor to produce column reflux. The coolant used for such condensation duty is supplied by a valve expanded stream of the oxygen-rich liquid. This coolant vaporizes and a portion of the stream is re-compressed either at the temperature of the warm or cold end of a main hem exchanger used in cooling the air to a temperature suitable for its distillation. The re-compressed, vaporized coolant is then introduced into the column in order to increase the overall recovery of the nitrogen. At the same time, part of the vaporized coolant can be partly warmed and then expanded with the performance of work. The expanded stream acts as a refrigerant to supply plant refrigeration. Part of the work of expansion is applied to the compression in order to conserve energy.

As will be discussed, the type of process, outlined above, can be operated to further increase the recovery of nitrogen product.

SUMMARY OF THE INVENTION

The present invention provides a method of producing nitrogen in which compressed, purified feed air is cooled to a temperature suitable for its rectification. The compressed, purified feed air is introduced into a distillation column to produce a nitrogen-rich tower overhead and an oxygen-rich liquid as column bottoms. At least part of the nitrogen-rich stream, composed of the nitrogen-rich tower overhead, is condensed and at least part of the resulting condensate is introduced into the distillation column as reflux. A nitrogen containing liquid is extracted from the distillation column. The nitrogen containing liquid has a nitrogen content greater than that of the oxygen-rich liquid. First and second coolant streams composed of the oxygen-rich liquid and the nitrogen containing liquid, respectfully, are expanded. At least part of the nitrogen-rich stream is condensed through indirect heat exchange with the first and second coolant streams, thereby to form vaporized first and second coolant streams. A nitrogen product is extracted from another part of the nitrogen-rich stream. The first vaporized coolant stream is partially warmed and expanded with the performance of work to form a refrigerant stream. Heat is indirectly exchanged between the refrigerant stream and the compressed and purified air. The second vaporized coolant stream is compressed either warm or cold and thereafter cooled to the temperature suitable for the distillation of the air. Thereafter, the second vaporized coolant stream is introduced into a bottom region of the distillation column to increase recovery of the nitrogen product.

In another aspect, the present invention provides an apparatus for producing nitrogen. In accordance with this aspect of the present invention, a main heat exchange means is provided for cooling compressed, purified feed air to a temperature suitable for its rectification. Such main heat exchange means also functions to partially warm a first vaporized coolant stream, to fully cool a second vaporized coolant stream to the temperature suitable for the rectification of the air and to indirectly transfer heat from the compressed purified feed air to a refrigerant stream. A distillation column is connected to the main heat exchange means to receive the compressed, purified feed air, thereby to produce a nitrogen-rich tower overhead and an oxygen-rich liquid column bottoms. A condensing means is provided for condensing at least part of the nitrogen-rich stream, composed of the nitrogen-rich tower overhead. The condensing means also functions to introduce at least part of the resulting condensate into the distillation column as reflux and to vaporize first and second coolant streams, thereby to form the first and second vaporized coolant streams. The condensing means is connected to the distillation column so that the first coolant stream is composed of the oxygen-rich liquid and the second coolant stream is composed of the nitrogen containing liquid having a nitrogen content greater than that of the oxygen-rich liquid. The condensing means is also connected to the main heat exchange means so that the first vaporized coolant stream partially warms therewithin. First and second expansion valves are interposed between the condensing means and the distillation column for valve expanding the first and second coolant streams, respectfully. A means is provided for extracting a nitrogen product from another part of the nitrogen-rich stream. An expansion means is connected to the main heat exchange means for expanding the first vaporized coolant stream with the performance of work and to thereby form the refrigerant stream. The main heat exchange means is also connected to the expansion means so that the compressed and purified air indirectly exchanges heat to the refrigerant stream. A compressor is connected to the condensing means for re-compressing the second vaporized coolant stream. The compressor is also connected to the main heat exchange means so that the second vaporized coolant steam cools therewithin. The distillation column is further connected to the main heat exchange means at a bottom region thereof for receiving the second vaporized coolant stream into the distillation column, after having been fully cooled to the temperature suitable for the rectification of the air.

The re-introduction of the second vaporized coolant stream back into the distillation column increases recovery of the nitrogen product. The second vaporized coolant stream is derived from a liquid nitrogen containing stream having a higher nitrogen content than the oxygen-rich liquid. As such, it has a higher dewpoint pressure for the same temperature of oxygen-rich liquid. Therefore, the supply pressure of the second vaporized coolant stream to the compressor is higher and thus, more flow can be compressed for the same amount of work. This increase in flow allows for an increase in heat pumping action which boosts recovery over the prior art in which the vaporized, crude-liquid oxygen stream is recirculated and returned to the column. Moreover, the stream composition of the nitrogen containing liquid is close to the equilibrium vapor composition in the sump of the column. This allows the bottom of the column to operate more reversibly than in the prior art.

It is to be noted that the term "fully warmed" means warmed to the warm end of the main heat exchanger. The term "fully cooled" means cooled to the temperature of the air prior to the introduction of the air into the distillation column. The term "partially warmed" means warmed to an intermediate temperature, namely a temperature between the warm and cold end temperatures of the main heat exchanger.

BRIEF DESCRIPTION OF THE DRAWINGS

While the specification concludes with claims distinctly pointing out the subject matter that Applicant regards as his invention, it is believed that the invention will be better understood when taken in connection with the accompanying drawing which is a sole figure illustrating a method of separating air in an apparatus of the present invention.

DETAILED DESCRIPTION

With reference to the Figure, an air separation plant 1 is illustrated for generating a nitrogen product. A compressed, purified feed air stream 10 is introduced into a main heat exchanger 12. Although not illustrated, in a manner well known in the art, feed air stream 10 is produced by filtering air with a filter to remove dust particles and then compressing the air. After the heat of compression is removed by an after-cooler, the air is purified within a pre-purification unit, normally containing beds of molecular sieve operating out of phase to remove carbon dioxide, moisture and hydrocarbons from the feed air.

Feed air stream 10 after having been cooled within main heat exchanger 12 to a temperature suitable for its distillation, is then introduced into an intermediate region of a distillation column 14 to produce a nitrogen-rich vapor tower overhead in a top region 16 of distillation column 14 and an oxygen-rich liquid column bottoms in a bottom region 18 of distillation column 14. Distillation column 14 can use trays, random packing, or structured packing to produce intimate contact with an ascending vapor phase and a descending liquid phase of the air to be separated in order to fractionate the air into nitrogen-rich vapor and the oxygen-rich liquid. Distillation column 14 is designed such that the nitrogen-rich vapor is high-purity nitrogen, that is nitrogen having a purity of less than 100 parts per billion of oxygen.

A nitrogen-rich stream 20 is extracted from distillation column 14. Nitrogen-rich stream is composed of the nitrogen-rich vapor tower overhead. A part 22 of nitrogen-rich stream 20 is condensed within a condenser 24. The resulting condensate is introduced back into distillation column 14 as reflux. As can be appreciated, all of the nitrogen-rich stream could be condensed. In such case, only part of the condensate would serve as reflux while a remaining part of the condensate could be taken as a product.

A first coolant stream 26 composed of the oxygen-rich liquid column bottoms is extracted from distillation column 14. A second coolant stream 28 is produced by extracting a nitrogen containing liquid from distillation column 14. Since the nitrogen containing liquid is extracted above bottom region 18 of distillation column 14, it has a nitrogen content greater than that of the oxygen-rich liquid that collects within bottom region 18 of distillation column 14. First and second coolant streams 26 and 28 are subcooled within a subcooling unit 30 and then are valve expanded within pressure reduction valves 32 and 34, respectfully. The pressure reduction reduces the temperature of first and second coolant streams 26 and 28 so that they can be used within head condenser 24 to condense part 22 of nitrogen-rich stream 20.

Another part 36 of nitrogen-rich stream 20 is initially warmed within subcooling unit 30 to the temperature of the cold end of the main heat exchanger 12. Thereafter, part 36 of nitrogen-rich stream 20 is fully warmed within main heat exchanger 12 to be discharged as a product gas nitrogen stream labelled $PGN_2$.

Vaporization within head condenser 24 causes first coolant stream 26 to become a first vaporized coolant stream 38. Similarly, vaporization of second coolant stream 28 causes a second vaporized coolant stream 40 to be produced. First vaporized coolant stream 38 is initially warmed within subcooler unit 30 to the temperature of the cold end of main heat exchanger 12 and then is partially warmed within main heat exchanger 12. First vaporized coolant stream 38 is thereafter introduced into a turboexpander 42 to produce a refrigerant stream 44. Refrigerant stream 44 warms within subcooler unit 30 and then fully warms within main heat exchanger 12 where it is discharged as a waste nitrogen stream labelled $WN_2$.

Second vaporized coolant stream 40 is compressed within a recycle compressor 46 and is then fully cooled. Recycle compressor 46 is coupled to turboexpander 42 so that part of the work of expansion is applied to the compression. A remaining part of the work of expansion is rejected as heat through an energy dissipative brake 47. Subsequently, second vaporized coolant stream 40 is introduced into the bottom region 18 of distillation column 14 in order to increase recovery of the nitrogen product. It is to be noted that the compressed, purified air stream is introduced into an intermediate location of distillation column 14. This intermediate location is one in which the incoming air of the same composition as the vapor phase of the air being separated within distillation column 14. The compressed, purified feed air stream 10 could however be combined with second vaporized coolant stream 40 and introduced into bottom region of distillation column 14. This however would not be as thermodynamically efficient as the illustrated embodiment.

In the illustrated embodiment, second vaporized coolant stream 40 is compressed at essentially the temperature at which the distillation of the air is conducted. The term "essentially" is used herein and in the claims because second vaporized coolant stream 40 would be slightly colder than the temperature of distillation column 14 at the intermediate entry point of compressed and purified air stream 10 and hence, the cold end of main heat exchanger 12. Although not illustrated, in an alternative embodiment, second vaporized coolant stream 40 could be fully warmed within main heat exchanger 12, re-compressed, and then fully cooled.

While the present invention has been described with reference to a preferred embodiment, as will occur to those skilled in the art, numerous changes, additions, and omissions can be made to such embodiment without departing from the spirit and scope of the present of invention.

I claim:

1. A method of producing nitrogen, said method comprising:

cooling compressed, purified feed air to a temperature suitable for its rectification;

introducing said compressed, purified feed air into a distillation column to produce a nitrogen rich vapor tower overhead and oxygen-rich liquid as column bottoms;

condensing at least part of a nitrogen-rich stream composed of said nitrogen-rich vapor tower overhead and introducing at least part of the resulting condensate into said distillation column as reflux;

extracting nitrogen containing liquid from said distillation column, said nitrogen containing liquid having a nitrogen content greater than that of said oxygen-rich liquid;

expanding first and second coolant streams composed of said oxygen-rich liquid and said nitrogen containing liquid, respectively;

condensing said at least part of said nitrogen rich stream with said first and second coolant streams, thereby to form vaporized first and second coolant streams;

extracting a nitrogen product from another part of said nitrogen rich stream;

partially warming and expanding said first vaporized coolant stream with performance of work to form a refrigerant stream;

indirectly exchanging heat between said refrigerant stream and said compressed and purified air; and compressing said second vaporized coolant stream, cooling said second vaporized coolant stream to said temperature and introducing said second vaporized coolant stream into a bottom region of said distillation column to increase recovery of said nitrogen product.

2. The method of claim 1, wherein said nitrogen product is extracted as a gaseous nitrogen product stream.

3. The method of claim 1, wherein said first compressed and purified feed air is introduced into an intermediate location of said distillation column.

4. The method of claim 1 or claim 3, wherein said second vaporized coolant stream is compressed at essentially said temperature.

5. The method of claim 4, wherein said first and second coolant streams are subcooled prior to their being expanded.

6. The method of claim 5, wherein:

said nitrogen product is extracted as a gaseous nitrogen product stream; and said gaseous nitrogen product stream, said refrigerant stream, and said first vaporized coolant stream indirectly exchange heat with said first and second coolant streams, thereby to subcool said first and second coolant streams.

7. The method of claim 6, wherein said gaseous product nitrogen stream and said refrigerant stream fully warm, said first vaporized coolant stream partially warms through indirect heat exchange with said compressed, purified feed air and said second vaporized coolant stream.

8. An apparatus for producing nitrogen, said apparatus comprising:

main heat exchange means for cooling compressed, purified feed air to a temperature suitable for its rectification, for partially warming a first vaporized coolant stream, for fully cooling a second vaporized coolant stream to said temperature, and for indirectly transferring heat from said compressed, purified feed air to a refrigerant stream;

a distillation column connected to said main heat exchange means to receive said compressed, purified feed air, thereby to produce a nitrogen rich tower overhead and an oxygen-rich liquid as column bottoms;

condensing means for condensing at least part of a nitrogen-rich stream composed of said nitrogen-rich tower overhead, for introducing at least part of the resulting condensate into said distillation column as reflux, and for vaporizing first and second coolant streams, thereby to form said first and second vaporized coolant streams;

said condensing means connected to said distillation column so that said first coolant stream is composed of said oxygen-rich liquid and said second coolant stream is composed of a nitrogen containing liquid having a nitrogen content greater than that of said oxygen-rich liquid;

said condensing means also connected to said main heat exchange means so that said first vaporized coolant stream partially warms therewithin;

first and second expansion valves interposed between said condensing means and said distillation column for valve expanding said first and second coolant streams, respectively;

means for extracting a nitrogen product from another part of said nitrogen rich stream;

expansion means connected to said main heat exchange means for expanding said first vaporized coolant stream with performance of work to form said refrigerant stream;

said main heat exchange means connected to said expansion means so that said compressed and purified air indirectly exchanges heat to said refrigerant stream; and a compressor connected to said condensing means for compressing said second vaporized coolant stream;

said compressor also connected to said main heat exchange means so that said second vaporized coolant stream cools therewithin; and said distillation column also connected to said main heat exchange means at said bottom region thereof for receiving said second vaporized coolant stream into said distillation column, after having been fully cooled to said temperature, thereby to increase recovery of said nitrogen product.

* * * * *